US007331534B2

(12) United States Patent
McQueen

(10) Patent No.: US 7,331,534 B2
(45) Date of Patent: Feb. 19, 2008

(54) RAIL PAD AND METHOD FOR STRAIN ATTENUATION

(76) Inventor: Philip Jeffrey McQueen, 2 Bedford Cove, San Rafael, CA (US) 94901

( * ) Notice: Subject to any disclaimer, the term of this patent is extended or adjusted under 35 U.S.C. 154(b) by 590 days.

(21) Appl. No.: 10/253,385

(22) Filed: Sep. 23, 2002

(65) Prior Publication Data

US 2005/0098648 A1 May 12, 2005

(51) Int. Cl.
*E01B 9/00* (2006.01)

(52) U.S. Cl. ..... 238/283; 238/382

(58) Field of Classification Search ..... 238/283, 238/382, 8, 349, 351; 428/98, 116, 119, 428/131, 136, 166, 188
See application file for complete search history.

(56) References Cited

U.S. PATENT DOCUMENTS 2,609,991 A * 9/1952 Jones ..... 238/283
2,809,145 A * 10/1957 McDermott ..... 428/135
3,026,224 A * 3/1962 Rogers, Jr. ..... 428/167
4,618,093 A * 10/1986 Young et al. ..... 238/283

* cited by examiner

*Primary Examiner*—Mark T. Le
(74) *Attorney, Agent, or Firm*—Risto A. Rinne, Jr.

(57) ABSTRACT

An apparatus for use as a pad and for placement intermediate a rail and a railroad tie includes a plurality of geometrical recesses that extend into the pad, either at a normal longitudinal axis or at an angle other than normal. An elastomeric material is used to form the pad. The recesses may include any geometric shape in plan at the surface of the pad. If desired, a tiered structure, is provided for any of the recesses. According to a modification, any of the recesses are modified to include a longitudinal axis that is not normal. The modified recesses include any geometrical, polygonal, circular, or oval shape in plan at the surface of the pad.

12 Claims, 2 Drawing Sheets

RAIL PAD AND METHOD FOR STRAIN ATTENUATION

RELATED APPLICATION

This application is related to patent application Ser. No. 09/716,387 filed on Nov. 20, 2000 by the same inventor, now U.S. Pat. No. 6,481,637 also entitled "Rail Pad & Method for Strain Attenuation" now approved for issuance as a patent. The specification and drawings of this patent application are hereby incorporated by reference herein as a part of this specification.

BACKGROUND OF THE INVENTION

1. Field of the Invention

The present invention, in general relates to rail pads and, more particularly, to rail pads that lessen abrasion of a concrete railroad tie.

Rail pads are typically placed intermediate each of the rails and each railroad tie. The railroad ties may be concrete or steel or other material. In general, the use of rail pads is well known in the railroad arts.

They are used to dampen the changes in loading that occur on the rails. This is sometimes referred to in the industry as "strain attenuation". Rail pads are also used to provide electrical isolation sufficient to electrically insulate the rail from the railroad tie and they also serve to lessen abrasion of the railroad ties. The industry term for this detrimental phenomenon is "rail-seat abrasion" and it is discussed in greater detail hereinafter.

These types of benefits are well known and are not elaborated herein other than to state that rail pads are generally required devices and that an improvement appertaining to any of these areas is desirable.

The railroad industry has, over time, increased the use of concrete railroad ties (over pressure treated types of wood and other materials, such as steel) to support the rails thereon. Concrete railroad ties have advantages over their wood counterparts and over other possible types of materials that may be used to form the railroad tie that appertain, primarily, to issues of durability, availability, environment, toxicity, consistency, and especially, longevity (i.e., life-cycle cost) matters.

However, their use is not now without problems. Previous types of rail pads that are placed intermediate the rail and the tie were designed to absorb and dampen the changes in the loading that are experienced by the rails that they support. This change is known as dynamic loading and rail pads must effectively dampen dynamic loads.

Some of the prior art patents mentioned hereinafter describe the design and construction of such types of rail pads. These prior types of rail pads, while providing many benefits, fail to adequately solve the problem of rail-seat abrasion. This problem exists whenever a rail pad is placed intermediate a rail and any type of a railroad tie.

If a rail makes direct contact with a railroad tie, movement of the rail in response to changes in dynamic loading directly abrades the tie. If the railroad tie is made of concrete this problem is worsened.

Rail-seat abrasion also occurs when a rail pad is placed intermediate the rail and the tie. One of the factors that exacerbates rail-seat abrasion includes the effects of greater axle loading. Heavier and more powerful locomotives as well as the trend toward having railroad cars with a greater carrying capacity means a greater axle loading. Accordingly, the potential magnitude of change in the dynamic loading that the rail pad can experience is increasing.

Another factor is that sand from locomotives (for improving traction) settles down and further abrades the ties. This is discussed in greater detail hereinafter.

Another factor affecting rail-seat abrasion by increasing the effective dynamic loading is known as "rail roll" and this occurs on curves.

Rail-seat abrasion is affected as well by many other factors, such as the speed of the train, the trend toward greater annual tonnage, the radius of the curve, and other elements. In general, rail-seat abrasion is a vexing problem in the railroad arts.

Former types of rail pads, which are elastomeric, deform and then recover under the changing stress of dynamic loading, such as occurs when the numerous axles of a train apply a compressive loading to the pads and then as each axle successively passes by until the next axle once again repeats the loading process.

The deformation of an elastomer (within the elastic limit) is well known in the mechanical arts. Compression of an elastomer inevitably results in its lateral deformation. The amount of this deformation is mathematically expressed by Poisson's ratio where Poisson's ratio is equal to the unit lateral deformation divided by the unit longitudinal deformation. Average values of Poisson's ratio may then be calculated for any type of material.

When an elastomeric object, such as a rail pad, experiences a downward (i.e., a vertical) force applied thereto, such as when an axle of a rail car applies a load to the pad, it undergoes compression due to the load being vertically applied and it must, accordingly, expand in other directions. Therefore the pad will deform horizontally.

When the compressive force is withdrawn, that is when the axle of the rail car passes beyond the rail pad, the additional (i.e., dynamic) loading is removed causing the elastomeric rail pad to both rise (i.e., to decompress) and also to retract horizontally, again in reverse compliance with Poisson's ratio.

As there are many axles in both passenger and freight trains that periodically pass over each rail pad there is considerable back and forth horizontal motion of the rail pad that is occurring. Multiply this event times all of the railroad ties and then multiply that number by two, because there are two railroad pads per tie, (i.e., one at each rail) to obtain an idea of the scope of the problem, which extends to all railroad pads.

This type of motion in the railroad industry is known as "scrubbing" or sometimes as "scuffing". The rail pad literally scrubs that portion of the railroad tie upon which it rests. This scrubbing action eventually abrades the top of the rail tie at the rail-seat area.

Due to scrubbing, the concrete is abraded (i.e., worn) into a dust that is sloughed off and carried away by rain and wind, thereby forming an ever deepening (in depth) pocket in the railroad tie at the rail-seat into which the rail pad increasingly descends. Scrubbing abrades the rail pad as well, thereby also contributing to premature rail pad disintegration.

The scrubbing action of the railroad pad upon the tie, if allowed to persist unchecked, eventually reduces the concrete section at the rail-seat which in turn dramatically decreases the life expectancy of the concrete railroad tie. This necessitates the premature replacement of many such railroad ties.

Eventually, if left unattended, the rail itself may begin to make contact with the tie during times of maximal loading.

This subjects the tie to unacceptable levels of stress and must be avoided. It also compromises the electrical insulation of the rail. It also has a deleterious influence on the longitudinal and lateral restraint aspects of the rail fastening system which are, in particular, essential for the proper securance of long-welded rails.

As the rail pad is required and as its dimensions are limited (i.e., its thickness is predetermined), the ties themselves must be replaced or repaired when they become sufficiently abraded (i.e., worn) by the scrubbing action of the rail pads.

It is a well known problem in the railroad industry to replace or repair an otherwise perfectly good concrete railroad tie that is no longer serviceable simply because it has been abraded by the horizontal scrubbing action of the rail pads. Attempts at rail-seat repair are also costly. In summary, rail-seat abrasion is a pervasive problem in the industry.

A satisfactory solution has not been forthcoming because it has been heretofore believed that there is no ideal way around the deleterious effects associated with Poisson's ratio. Various types of railroad pads attempt to ameliorate the problems of dynamic loading via compression of the elastomer but no satisfactory solution to the problem of "scrubbing" is presently known or available other than the related application that was mentioned hereinabove.

Pads of composite materials, dual-durometer materials, pads that are laminated and which include a steel-layer therein (three-layer pads), as well as pads having various other shapes, such as protrusions or embedded dimples, also do not completely solve the problem.

Certain of these rail pads, while they do lessen rail seat abrasion, are considerably more expensive to manufacture, for example dual-durometer and steel-layer types of pads.

The use of dimples is disclosed in a previously issued patent to the present inventor, and is identified in greater detail hereinafter in the listing of prior art references.

While dimples well provide for a rail pad that more effectively dampens the effects of loading, Poisson's ratio inevitably assures us that that loading will be translated into a scrubbing action that is exhibited by the bottom of the pad that is proximate the dimples upon the top surface of the railroad ties. Similarly, for all other techniques of creating a rail pad, Poisson's ratio will repeatedly change the horizontal dimensions of the pad sufficient to abrade (and degrade) the railroad tie in response to the dynamic loading that the pad experiences and thereby scrub the railroad tie upon which it is placed.

The scrubbing action not only causes premature wear of the railroad tie but also contributes to the premature wear of the pad itself. Accordingly, rail pads must be periodically replaced until, eventually, the tie itself may require replacement because of the protracted abrasion that is caused by the scrubbing action of the pads.

As was mentioned hereinabove, the problem of "rail roll" on curves is another important consideration. There exists a need to both improve damping by a rail pad and also to mitigate scrubbing of the tie during curves when the forces that are transmitted through the rail to the rail pad and tie include an increased force that occurs on one side (i.e., the outside) of the rail due to an increased lateral force (i.e., roll) being applied to the rail by the centrifugal force associated with changing the direction of the train.

Clearly, it is desirable to extend the service life of both rail pads and railroad ties. Replacement of either the pad or the tie is labor intensive and therefore, quite expensive. Any significant improvement that extends the interval between which either the tie or the rail pad (or both) are replaced, is especially desirable.

Accordingly, there exists today a need for a cost-effective rail pad that provides effective elastomeric damping of the loading that is experienced by a rail and which decreases horizontal movement of the pad upon the railroad tie.

Clearly, a railroad pad that decreases scrubbing action would be a useful and desirable device. A method for accomplishing strain attenuation in a rail pad that minimizes scrubbing action is especially valuable.

2. Description of Prior Art

Rail pads and rail support systems are, in general, known. For example, the following patents describe various types of these devices:

U.S. Pat. No. 4,572,431 to Arato, Feb. 25, 1986;
U.S. Pat. No. 4,648,554 to McQueen, Mar. 10, 1987;
U.S. Pat. No. 5,110,046 to Young, May 5, 1992;
U.S. Pat. No. 5,261,599 to Brown, Nov. 16, 1993;
U.S. Pat. No. 5,549,245 to Kish, Aug. 27, 1996;
U.S. Pat. No. 5,551,632 to Kish, Sep. 3, 1996;
U.S. Pat. No. 5,551,633 to Kish, Sep. 3, 1996; and
U.S. Pat. No. 6,045,052 to Besenschek, Apr. 4, 2000.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a rail pad that decreases abrasion of a rail tie.

It is also an important object of the invention to provide a rail pad that increases the useful life of a rail tie.

Another object of the invention is to provide a rail pad that decreases abrasion of a concrete rail tie.

Still another object of the invention is to provide a rail pad that increases the life of a concrete rail tie.

Still yet another object of the invention is to provide a rail pad that increases the useful life of a rail pad.

Yet another important object of the invention is to provide a rail pad that reduces the horizontal movement of a rail pad during the application and removal of a dynamic load.

Still yet another important object of the invention is to provide a rail pad that is placed intermediate the top of a rail tie and the bottom of a rail and which reduces the horizontal scrubbing of the bottom of the rail pad upon the top of the rail tie that occurs during the application and subsequent removal of a dynamic load that is applied to the rail.

One other object of the invention is to provide a rail pad that creates shear within the pad as it transfers the load that is applied to the top thereof to a railroad tie that is disposed under the pad.

One further object of the invention is to provide a rail pad that deforms internally in response to a compressive load being applied thereto.

One additional object of the invention is to provide a rail pad that includes a plurality of geometric recesses that are disposed on opposite sides thereof.

One yet further important object of the invention is to provide a method for strain attenuation in a rail pad that minimizes scrubbing action upon a rail tie.

One yet further additional object of the invention is to provide a rail pad that includes a plurality of geometric recesses that are disposed on one or more sides thereof and which are disposed at an angle with respect to a normal surface of the rail pad.

Briefly, a rail pad for use intermediate a rail and a rail tie that is constructed in accordance with the principles of the present invention has a plurality of first geometrical recesses that are disposed on a first side of the rail pad and a plurality of second geometrical recesses that are disposed on a second side of the rail pad. At least an edge of one of the first geometrical recesses aligns with at least an edge of one of the second geometrical recesses based on a longitudinal axis of the first geometrical recess. The amount of alignment can extend to include an overlapping of at least some of the common area of the geometrical recesses, according to a first modification. A longitudinal axis of the geometrical recesses are perpendicular with respect to a surface of the rail pad. Each of the first and second geometrical recesses extend into the rail pad a predetermined depth and each of the geometrical recesses includes a first end that is disposed at the surface of the rail pad and a second end that is disposed distally with respect to the first end. The second end is disposed within the body of the rail pad. The second end, according to a second modification, is reduced in diameter and a smaller geometric recess extends further into the body of the rail pad thereby providing a "tiered" geometrical recess. According to a third modification, at least some of the geometric recesses are disposed at an angle other than normal. The orientation of the geometric recesses provide a method that converts a portion of the compressive loading into shear stress which results in a shearing action occurring within the rail pad that lessens the amount of lateral deformation. Deformation of the rail pad due to shear and the effects of Poisson's ratio (due to some compression of the pad) occur substantially within the pad itself, thereby minimizing horizontal movement of the pad (i.e., minimizing scrubbing).

DETAILED DESCRIPTION OF THE INVENTION

Figure 1:
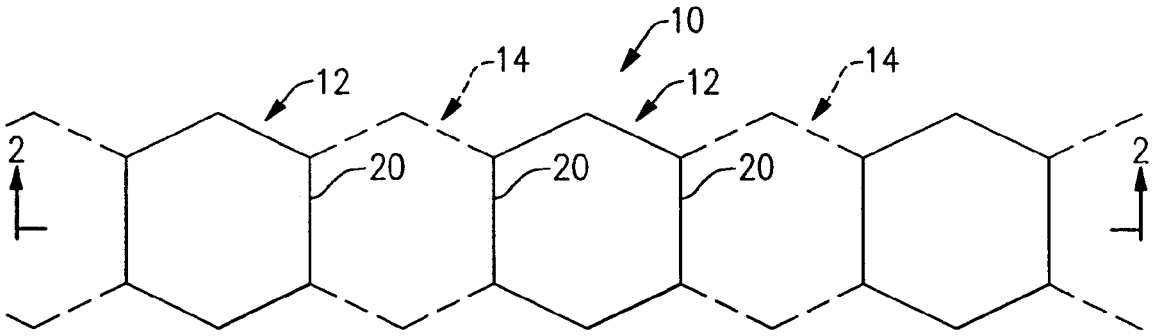
FIG. 1 is an enlarged top (plan) view of a portion of an active area of a rail pad wherein an edge of a first geometric recess aligns with an edge of a second geometric recess.
Figure 2:
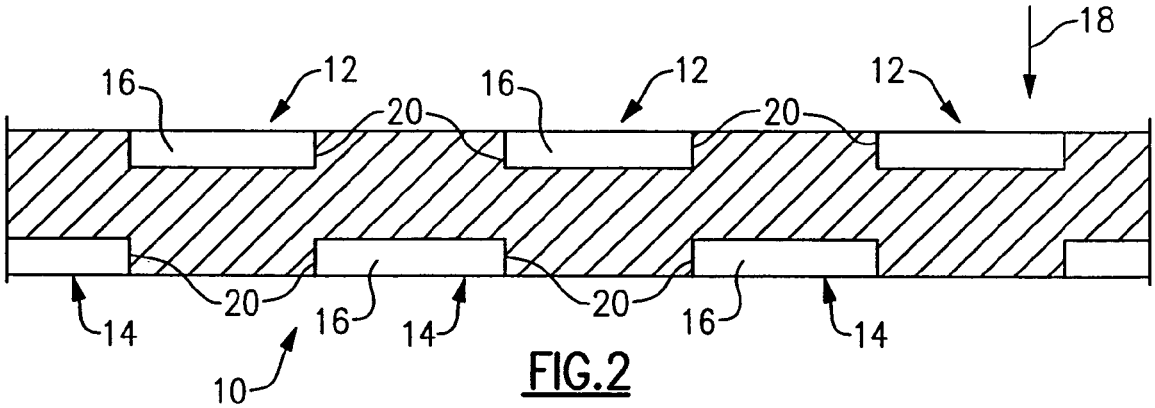
FIG. 2 is a cross sectional view taken on the line 2-2 in FIG. 1.

Referring on occasion to all of the figure drawings and in particular now to FIG. 1 and FIG. 2 is shown, a portion of an active area of a rail pad, identified in general by the reference numeral 10.

The portion of the pad 10, as shown, repeats throughout as much of the active area as is desired and each portion 10 may be disposed adjacent to the portion 10 that is shown or it may include a space therebetween, as desired.

The shape, configuration, and outer dimensions of the rail pad are well known in the industry and are described in the related application Ser. No. 09/716,387, which is included by reference herein. This type of a rail pad is commonly referred to in the industry as the type for use with a "six inch base rail" (not shown) and for one particular type of rail fastening hardware (not shown) that is well known in the art. The instant invention is adaptable for use with other sizes of rail pads (not shown) and for use with other types of rail fastening hardware (not shown).

The portion of the rail pad 10 is formed of any preferred elastomeric material having any preferred durometer. It is adaptable for use with layer rail pads (not shown) and with other types of rail pads (not shown). The portion of the rail pad 10 may be used with any modification that is, or shall become, known appertaining to rail pad construction and its use accordingly in other rail applications is anticipated along with various changes being made to any of the dimensions or materials used to form the portion of the rail pad 10. Those who possess ordinary skill in the design or manufacture of known types of rail pads (not shown) will, accordingly, benefit from the description herein and be able apply these teachings accordingly.

A plurality of first geometrical recesses, identified in general by the reference numeral 12, are included on a first side of the rail pad 10 and a plurality of second geometrical recesses, identified in general by the reference numeral 14, are included on a second side of the rail pad 10.

The geometrical recesses 12, 14 as shown include a hexagonal shape (in plan), however they may include any geometrical shape that is preferred or found to be especially effective. For example, triangular, rectangular, square, pentagonal, or any other polygonal shape is possible for construction of any of the geometrical recesses 12, 14 as described throughout this specification.

Each of the geometrical recesses 12, 14 includes a first end that is planar alignment with a normal surface of the pad 10. A remaining portion of each of the geometrical recesses 12, 14 extends into the pad 10 a predetermined amount and terminates at a second end that is opposite with respect to the first end. A void 16 is provided in the pad 10 for each geometrical recess 12, 14 that includes the preferred hexagonal or other geometrical shape (in plan) and which extends into the pad 10 until the second end is reached.

It is possible to provide a uniquely modified pad with a variable geometrical shape (not shown) so that one particular geometrical shape begins at the normal surface of the pad and changes into another geometrical shape as the geometrical recess 12, 14 extends into the pad 10. For example, the first end of the uniquely modified pad may include a hexagonal (or any other polygonal) shape (in plan) and the second end may include some other type of a shape (in plan). While this is not necessarily preferred, it is described herein only to illustrate one possible type of modification that has been anticipated.

Assuming that the pad 10 is disposed under the rail (not shown) and above a tie (not shown), the direction of loading is generally as shown by arrow 18. When each axle (not shown) of a train (not shown) passes over the rail, the weight produces an increase in loading experienced by the pad 10. When the loading increases, the first geometrical recesses 12 deflects slightly downward toward the second geometrical recesses 14 resulting in shear occurring at a common edge 20. The amount of deflection is a function of the loading and the durometer of the elastomer used to form the pad 10.

At least one common edge 20 is provided for each opposing pair of geometrical recesses 12, 14. The common edge 20 of the first geometrical recess 12 aligns with the common edge 20 of the second geometrical recess 14. The common edge 20 of the first geometrical recess 12 is normal with respect to the common edge 20 of the second geometrical recess.

Accordingly, due to the opposing common edges 20, a portion of the strain experienced by the pad 10 is attenuated in shear within the pad 10. Any strain that is attenuated in shear does not laterally deform the pad 10 according to Poisson's Ratio. This, thereby, reduces the amount of scrubbing of the lower surface of the pad 10 upon the tie.

A substantial amount of the remaining strain, not compensated for by damping in shear, occurs by an expansion of the elastomer of the pad 10 into the void 16 of the first and second geometrical recesses 12, 14. This further lessens lateral deformation of the pad 10, thereby further reducing scrubbing.

Figure 3:
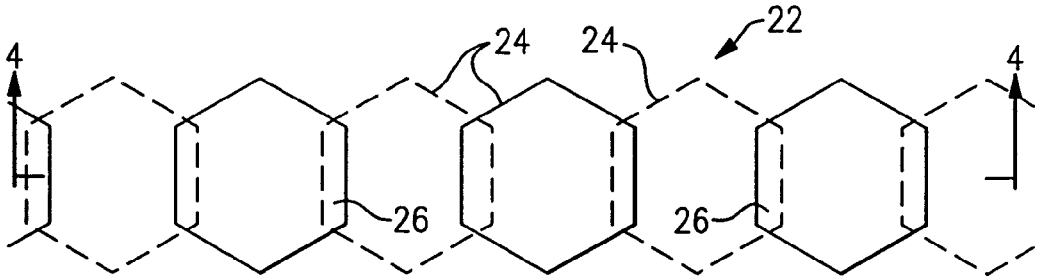
FIG. 3 is an enlarged top (plan) view of a portion of an active area of a first modified rail pad wherein an edge of a first geometric recess overlaps an edge of a second geometric recess.
Figure 4:
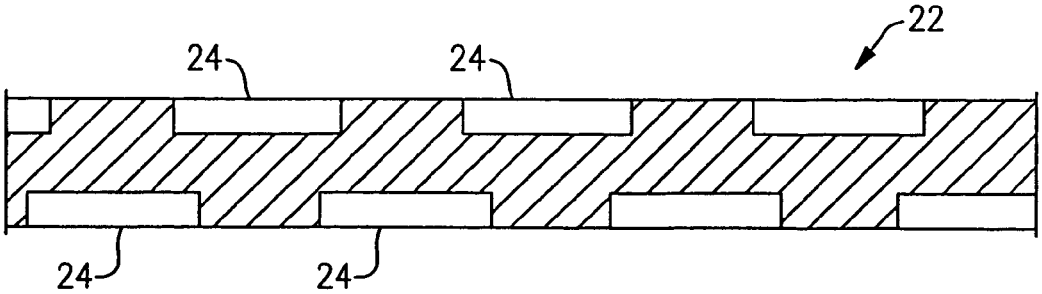
FIG. 4 is a cross sectional view taken on the line 4-4 in FIG. 3.

Referring now to FIGS. 3 and 4, a first modified pad 22 includes a plurality of first modified geometrical recesses 24 that are disposed on opposite sides of the modified pad 22. The first modified geometrical recesses 24 are similar to the first and second geometrical recesses 12, 14 previously described, however, the first modified geometrical recesses 24 include an area of overlap 26.

The area of overlap 26 is that portion of each pair of the first modified geometrical recesses 24 that are disposed on opposite sides of the first modified pad 22 that overlap each other when taken along a normal (perpendicular) line of the surface of the first modified pad 22.

By varying the amount of overlap 26, as well as the particular geometric shape, the amount of strain that is attenuated in shear can be varied. This is useful in designing variations of the first modified pad 22 to accommodate heavier or lighter types of loading. For example, a softer version is desired for use with passenger trains whereas a stiffer version is desired for use with freight trains.

Figure 5:
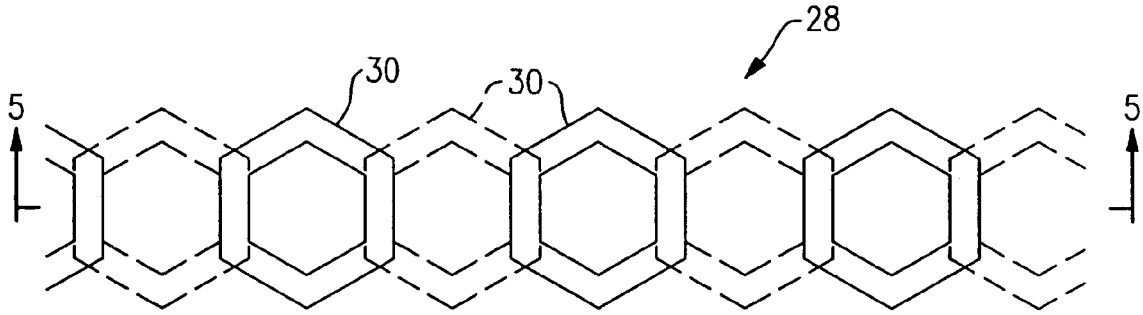
FIG. 5 is an enlarged top (plan) view of a portion of an active area of a second modified rail pad wherein a pair of edges of a tiered geometric recess overlaps a pair of edges of a tiered geometric recess disposed on an opposite side.
Figure 6:
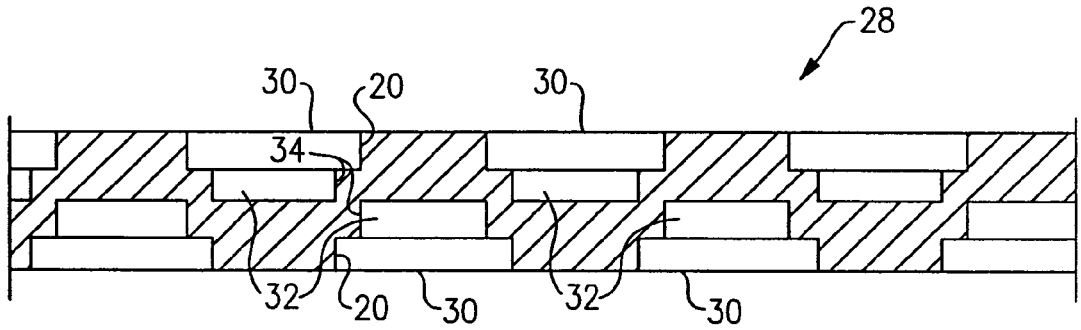
FIG. 6 is a cross sectional view taken on the line 5-5 in FIG. 5.

Referring now to FIGS. 5 and 6, a second modified pad 28 includes a plurality of second modified geometrical recesses 30 that are disposed on opposite sides of the modified pad 28.

The second end of any of the first and second geometrical recesses 12, 14, as previously described are, according to a modification, reduced in diameter and a smaller geometric recess 32 is provided that extends further into the body of the rail pad thereby providing a "tiered" type of cross-section for the second modified geometrical recesses 30.

The second modified pad 28 provides for an additional edge alignment whereby a modified edge 34 of the smaller geometric recess 32 of any of the second modified geometrical recesses 30 aligns with a common edge 20 of an upper portion of one of the second modified geometrical recesses 30 that are disposed on an opposite side of the second modified pad 28 along a normal axis of the second modified pad 28.

Also, a common edge 20 of any of the second modified geometrical recesses 30 aligns with a modified edge 34 of an upper portion of one of the second modified geometrical recesses 30 that are disposed on an opposite side of the second modified pad 28.

Accordingly, two edge pairs 20, 34 align on at least one, and preferably more, of the sides of the tiered second modified geometrical recesses 30. This provides for even greater shear within the second modified pad 28.

The first and second geometrical recess portions 12, 14 of each of the second modified geometrical recesses 30 are disposed at an upper surface of the second modified pad 28 and may include any polygonal shape.

Similarly, the smaller geometric recess 32 of any of the second modified geometrical recesses 30 may include any polygonal shape.

Figure 7:
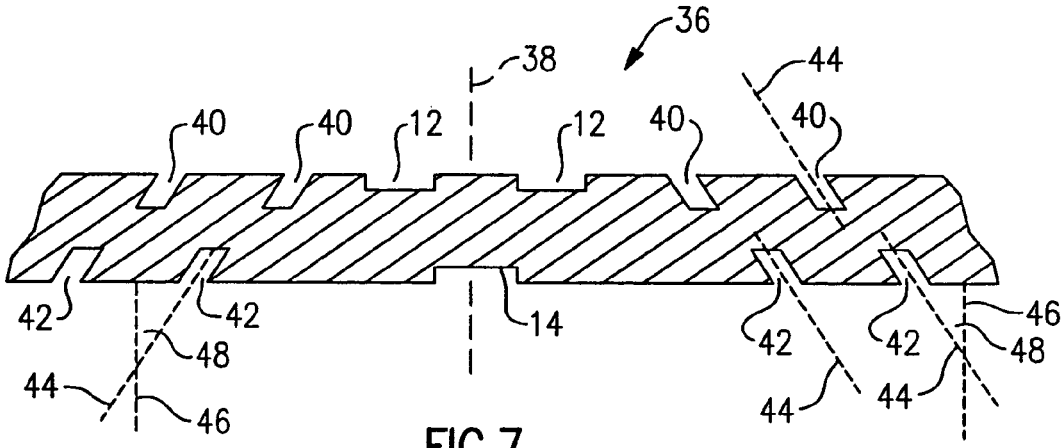
FIG. 7 is a cross sectional view of a portion of a third modified rail pad wherein a third modified first geometrical recess and a third modified second geometrical recess includes a longitudinal axis that is not normal with respect to a surface of the rail pad.

Referring now to FIG. 7, is shown a cross sectional view of a portion of a third modified pad 36. A normal centerline 38 corresponds to a geometric center of the active area of the third modified pad 36.

If preferred, a plurality of the first and second geometric recesses 12, 14 are provided proximate the centerline 38. To the right, as shown, of the centerline 38, a plurality of third modified first geometrical recesses 40 are disposed on one side of the third modified pad 36 and a plurality of third modified second geometrical recesses 42 are disposed on an opposite side, each of which includes a longitudinal axis 44 that is not normal with respect to a surface of the third modified rail pad 36. An intersection of the longitudinal axis 44 with a normal line 46 defines an angle 48 that the longitudinal axis 44 varies from normal.

The third modified first and second geometrical recesses 40, 42 may include any geometrical polygonal shape as well as including any cylindrical or oval shape.

The third modified first and second geometrical recesses 40, 42, being disposed at the angle 48 that is not normal (i.e., perpendicular) with the surface provide for improved shear, and therefore strain attenuation, when there is a lateral force applied to the rail, for example on curves.

If desired, the angle 48 may be maintained throughout the active area of the third modified pad 36 for all of the third modified first and second geometrical recesses 40, 42 or, if desired, the angle 48 may be changed anywhere within any portion of the active area of the third modified pad 36.

As shown, the angle 48 is shown for all of the third modified first and second geometrical recesses 40, 42 that are disposed to the right of the centerline 38. However for all of the third modified first and second geometrical recesses 40, 42 that are disposed to the left of the centerline 38, the magnitude of the angle 48 is maintained, however the direction is changed. Accordingly, the third modified first geometrical recesses 40 are disposed closer to the centerline 38 than are the third modified second geometrical recesses 42.

Such a configuration is intended to provide effective strain attenuation for both normal and lateral forces applied to the rail, including lateral forces that may be applied in either direction, for example, due to shaking of the train cars, shifting loads, etc.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A rail pad that includes an active area which is adapted to be disposed intermediate a rail and a tie, wherein the improvement comprises:

at least one geometrical recess disposed in said active area of said rail pad, said at least one geometrical recess having a polygonal configuration at a surface of said rail pad and wherein said polygonal configuration of said at least one geometrical recess is not square or rectangular and wherein said geometrical recess is disposed on a first planar surface of said rail pad and wherein said geometrical recess includes an edge that is attached to a plane and wherein said plane extends into said rail pad a predetermined distance, and wherein said plane is normal with respect to said first planar surface, and said at least one geometrical recess has a second recess disposed at a bottom surface of said at least one geometrical recess.

2. The rail pad of claim 1 wherein said at least one geometrical recess includes a plurality of geometrical recesses and wherein at least one of said plurality of geometrical recesses include said polygonal configuration at a surface of said rail pad that is not square or rectangular.

3. The rail pad of claim 2 wherein said plurality of geometrical recesses are disposed on said first planar surface of said rail pad.

4. The rail pad of claim 2 wherein a portion of said plurality of geometrical recesses are disposed on said first planar surface and a remaining portion of said plurality of geometrical recesses are disposed on a second planar surface of said rail pad, said second planar surface being disposed on an opposite side of said rail pad with respect to said first planar surface.

5. The rail pad of claim 4 wherein at least some of said plurality of geometrical recesses that are disposed on said first planar surface includes said edge, and wherein said edge aligns with an edge of at least one of said plurality of geometrical recesses that are disposed on said second planar surface.

6. The rail pad of claim 4 wherein at least some of said plurality of geometrical recesses that are disposed on said first planar surface includes said edge, and wherein said edge overlaps with an edge of at least one of said plurality of geometrical recesses that are disposed on said second planar surface.

7. The rail pad of claim 1 wherein said polygonal configuration of all of said geometrical recesses includes any polygon that is not square or rectangular.

8. The rail pad of claim 1 wherein said polygonal recess includes a longitudinal axis that is normal with respect to a surface of said rail pad.

9. The rail pad of claim 1 wherein said polygonal recesses includes a longitudinal axis that is other than normal with respect to a surface of said rail pad.

10. A method of attenuating strain in a rail pad that includes an elastomeric material and which includes an active area that is adapted to be disposed intermediate a rail and a tie, comprising the steps of:

(a) providing at least one geometrical recess disposed in said active area on at least one side of said rail pad, said geometrical recess having a polygonal configuration at a surface of the rail pad and extending into the rail pad a predetermined distance and wherein said at least one geometrical recess includes an edge that extends along a side of said polygonal configuration and wherein said edge includes a plane that extends into said rail pad a predetermined distance, and wherein said plane is normal with respect to said at least one side of said rail pad and wherein said at least one geometrical recess includes a center longitudinal axis that is perpendicular with respect to said one side of said rail pad, and said at least one geometrical recess has a second recess disposed at a bottom surface of said at least one geometrical recess; and (b) providing at least one other geometrical recess that is disposed on a side opposite said one side, said at least one other geometrical recess having a polygonal configuration at a surface of the rail pad and extending into the rail pad a predetermined distance and wherein said at least one other geometrical recess includes a second edge that extends along a side of said polygonal configuration and wherein said edge and said second edge align along a substantial portion of a length of said side, or wherein said edge and said second edge include an overlap with respect to each other that extends along a substantial portion of said length of said side and wherein an area of said at least one geometrical recess is not in alignment with an area of said at least one other geometrical recess and wherein said at least one other geometrical recess is disposed maximally close to said center longitudinal axis and wherein no remaining other geometrical recess that is disposed on said side opposite said one side is disposed closer to said center longitudinal axis than is said at least one other geometrical recess;

wherein subsequent to the application of a compressive load to said rail pad, a portion of said compressive load is manifest as shear within said rail pad sufficient to displace at least a portion of said one geometrical recess with respect to at least a portion of said one other geometrical recess along a longitudinal axis that is perpendicular with respect to said one side.

11. A rail pad that includes an active area which is adapted to be disposed intermediate a rail and a tie, wherein the improvement comprises:

a plurality of geometrical recesses that are disposed in said active area of said rail pad, and wherein at least one of said geometrical recesses includes a polygonal configuration that is disposed at a first planar surface of said rail pad and wherein said at least one geometrical recess includes an edge that extends along a side of said polygonal configuration and wherein said edge includes a plane that extends into said rail pad a predetermined distance, and wherein said plane is normal with respect to said first planar surface, and said at least one geometrical recess has a second recess disposed at a bottom surface of said at least one geometrical recess; and wherein a remaining portion of said plurality of geometrical recesses are disposed on a second planar surface of said rail pad, said second planar surface being disposed on an opposite side of said rail pad with respect to said first planar surface, and wherein at least one of said remaining portion of said plurality of geometrical recesses includes a polygonal configuration that is disposed at said second planar surface and wherein said at least one of said remaining portion of said plurality of geometrical recesses includes a second edge that extends along a side of said polygonal configuration and wherein said edge and said second edge align along a substantial portion of a length of said side, or wherein said edge and said second edge include an overlap with respect to each other that extends along a substantial portion of said length of said side;

and wherein said polygonal configuration of said at least one of said geometrical recesses is not square or rectangular.

12. A rail pad that includes an active area which is adapted to be disposed intermediate a rail and a tie, wherein the improvement comprises:

at least one geometrical recess disposed in said active area of said rail pad, said at least one geometrical recess having a polygonal configuration at a first planar surface of said rail pad, and wherein said at least one geometrical recess includes a first end that is disposed at said first planar surface, and wherein said at least one geometrical recess includes an opening that is disposed at said first end and wherein said opening includes said polygonal configuration, and wherein said at least one geometrical recess extends into said rail pad for a predetermined depth and wherein said at least one geometrical recess includes a second end that is distally disposed with respect to said first end and wherein said at least one geometrical recess includes a second recess, and wherein said second recess includes an area that is parallel with respect to said first planar surface and wherein said area of said second recess is less than a corresponding area of said at least one geometrical recess, and wherein said second end of said at least one geometrical recess includes an area that is equal to said area of said second recess, and wherein said second recess includes a second opening that is disposed at said second end of said at least one geometrical recess and wherein said second recess extends a second predetermined depth into said rail pad.

* * * * *